United States Patent [19]

Martan et al.

[11] 4,104,141

[45] Aug. 1, 1978

[54] ELECTROCHEMICAL OXIDATION OF ALKOXY-SUBSTITUTED AROMATIC COMPOUNDS

[75] Inventors: Michael Martan, Rehovot, Israel; Mark A. Halter, Arlington Heights, Ill.

[73] Assignee: UOP Inc., Des Plaines, Ill.

[21] Appl. No.: 821,454

[22] Filed: Aug. 3, 1977

Related U.S. Application Data

[63] Continuation-in-part of Ser. No. 752,653, Dec. 20, 1976, abandoned.

[51] Int. Cl.[2] ..... C25B 3/02
[52] U.S. Cl. ..... 204/78
[58] Field of Search ..... 204/78

[56] References Cited

U.S. PATENT DOCUMENTS 4,046,652 9/1977 Pistorius et al. ..... 204/78

*Primary Examiner*—R. L. Andrews
*Attorney, Agent, or Firm*—James R. Hoatson, Jr.; Raymond H. Nelson; William H. Page, II

[57] ABSTRACT

The electrochemical oxidation of alkoxy-substituted aromatic compounds in which a desired position isomer is obtained may be effected by treating the aromatic compound with an aliphatic acid containing at least 4 carbon atoms in the presence of a phase transfer agent, said reaction being effected in an electrochemical cell. In the present invention the position isomer which comprises the para compound is prepared by treating a substituted aromatic compound such as anisole with a bulky acid such as pivalic acid in an electrochemical cell whereby the desired oxidized product is recovered on the anode.

10 Claims, No Drawings

ELECTROCHEMICAL OXIDATION OF ALKOXY-SUBSTITUTED AROMATIC COMPOUNDS

CROSS-REFERENCE TO RELATED APPLICATIONS

This application is a continuation-in-part of our copending application Ser. No. 752,653 filed Dec. 20, 1976 now abandoned, all teachings of which are specifically incorporated herein by reference.

BACKGROUND OF THE INVENTION

It has been shown in the prior art that desired position isomers such as the ortho isomer may be obtained by adding $\pi$-donating compounds such as polynuclear aromatic compounds such as naphthalene and anthracene to a reaction mixture. Likewise, the prior art has also disclosed that when anisole is subjected to an acetoxylation process, the ortho to para ratio is about 2:1 at low conversions of from 5% to 10% and increases to about 4:1 at a 25% conversion of the anisole. The usual prior art systems which were employed in the acetoxylation of aromatic compounds utilized non-emulsion conditions. This type of reaction required a relatively high operating voltage in the range of about 20 volts in order to obtain a reasonable current density. Therefore, the desired products were obtained at a high cost of power per pound of product.

In many instances, it has been found that the desired position isomer comprises the para isomer and therefore it has been unexpectedly discovered that by effecting the electrochemical oxidation of alkoxy-substituted aromatic compounds in the presence of an acid of the type hereinafter set forth in greater detail as well as salts thereof and also in the presence of a phase transfer agent, it is possible to reverse the ortho:para ratio which was present in reactions involving methods set forth in the prior art and therefore make it possible to obtain a greater amount of the desired para isomer. That is, by using bulky acids and emulsion conditions it is possible to carry out the electrochemical oxidation of an aromatic compound to a relatively high conversion rate without significantly losing the selectivity of desired products.

This invention relates to a process for the electrochemical oxidation of alkoxy-substituted aromatic compounds. More specifically, the invention is concerned with a process for obtaining improved yields of the desired position isomer during the electrochemical oxidation of alkoxy-substituted aromatic compounds.

Certain chemical compounds, and especially those which contain two substituents in a position para to each other, comprise desired reaction products which are useful in the chemical field. For example, hydroxyanisole may be synthesized electrochemically from anisole. The reaction is carried out in an electrochemical cell so that the desired product is obtained at the anode, said reaction involving the anodic oxidation of anisole in the presence of a nucleophile such as acetate ions which lead to acetoxylation in the ortho and para positions. The para isomer of the reaction constitutes a valuable intermediate inasmuch as the acetoxylated product in which the acetoxy substituent is in a para position is an intermediate for the production of p-hydroxyanisole, this compound being the precursor of t-butylhydroxyanisole which is an antioxidant useful in preventing the oxidation of edible fats and oils. In addition to being admixed with these fats and oils it is also used in food packaging, the wrappings for the foods containing this compound.

It is therefore an object of the present invention to provide a process for the electrochemical oxidation of alkoxy-substituted aromatic compounds.

A further object of this invention is to provide a method for obtaining improved yields of desired position isomers which result from the electrochemical oxidation of alkoxy-substituted aromatic compounds.

In one aspect an embodiment of this invention resides in a process for the electrochemical oxidation of an alkoxy-substituted aromatic compound which comprises treating said compound at reaction conditions with an acid having the formula:

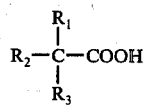

in which at least 2 R's are alkyl groups containing from 1 to about 10 carbon atoms and the remaining R is hydrogen or an alkyl group containing from 1 to about 10 carbon atoms and an alkali or alkaline earth metal salt of such an acid and a phase transfer agent comprising a symmetrical or asymmetrical tetraalkylnitrogen or phosphorus-based salt containing from 1 to about 20 carbon atoms in the alkyl chain, in an electrochemical cell maintained at a voltage in the range of from about 2 to about 20 volts and a current density in the range of from about 20 to about 200 milliamperes/square centimeter, and recovering the resultant acetoxylated alkoxy-substituted aromatic compound.

A specific embodiment of this invention is found in a process for the electrochemical oxidation of an alkoxy-substituted aromatic compound which comprises treating anisole with pivalic acid in the presence of tetraethylammonium sulfate in an electrochemical cell utilizing electrical energy conditions which include a voltage in the range of from about 2 to about 20 volts and a current density in the range of from about 20 to about 200 milliamperes per square centimeter (ma/cm$^2$) at ambient temperature and atmospheric pressures, and recovering the resultant p-pivaloxyanisole.

Other objects and embodiments will be found in the following further detailed description of the present invention.

As hereinbefore set forth the present invention is concerned with a process for the electrochemical oxidation of alkoxy-substituted aromatic compounds whereby a desired position isomer, and particularly the para isomer, of a disubstituted compound is obtained. The electrochemical oxidation is effected by treating an alkoxy-substituted aromatic compound of the type hereinafter set forth in greater detail with a fatty acid containing at least 4 carbon atoms, and preferably an iso or tertiary acid, and an alkali metal or alkaline earth metal salt thereof in the presence of a phase transfer agent in an electrochemical cell. By utilizing such a combination of components such as the acid, water, organic solvent and phase transfer agent, it is possible to provide an emulsion medium in which to effect the electrochemical oxidation of the aromatic compound. Examples of alkoxy-substituted aromatic compounds (also known as alkylaromatic ethers) which will undergo the electrochemical oxidation will include methyl phenyl ether (anisole), ethyl phenyl ether (phenetole), propyl phenyl ether (propoxybenzene), isopropyl phenyl ether (isopropoxybenzene), n-butyl phenyl ether, sec-butyl phenyl ether, t-butyl phenyl ether, n-amyl phenyl ether, isoamyl phenyl ether, the isomeric hexyl, heptyl, octyl, nonyl, decyl, etc., phenyl ethers, etc.

The aforementioned alkoxy-substituted aromatic compounds are treated with fatty acids which possess the general formula:

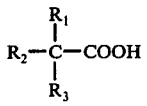

in which at least two R's are alkyl groups containing from 1 to about 10 carbon atoms and the remaining R is hydrogen or an alkyl group of from 1 to about 10 carbon atoms and an alkali metal or alkaline earth metal salt thereof. Some specific examples of these acids will include isobutyric acid, pivalic acid, isovaleric acid, 2,2-dimethylbutyric acid, isocaproic acid, 2-methylisocaproic acid, 2,2-diethylbutyric acid, 2,2-dimethylvaleric acid, 2,2-dimethylcaproic acid, isoenanthylic acid, 2-methylisoenanthylic acid, 2,2-diethylenanthylic acid, 2,2-dimethylenanthylic acid, isocaprylic acid, 2,2-dimethylcaprylic acid, 2,2-diethylcaprylic acid, isopelargonic acid, 2,2-dimethylpelargonic acid, 2,2-diethylpelargonic acid, 2,2-dipropylpelargonic acid, isocapric acid, etc. It is to be understood that the aforementioned acids are only representative of the type of compounds which may be employed and that the present invention is not necessarily limited thereto. In addition, the reaction is also effected in the presence of alkali metal or alkaline earth metal salts of these acids such as sodium isobutyrate, potassium isobutyrate, lithium isobutyrate, cesium isobutyrate, magnesium isobutyrate, calcium isobutyrate, strontium isobutyrate, sodium pivalate, potassium pivalate, lithium pivalate, cesium pivalate, magnesium pivalate, calcium pivalate, strontium pivalate, sodium isovalerate, potassium isovalerate, lithium isovalerate, cesium isovalerate, magnesium isovalerate, calcium isovalerate, strontium isovalerate, sodium isocaproate, potassium isocaproate, lithium isocaproate, cesium isocaproate, magnesium isocaproate, calcium isocaproate, strontium isocaproate, sodium isocaprylate, potassium isocaprylate, lithium isocaprylate, cesium isocaprylate, magnesium isocaprylate, calcium isocaprylate, strontium isocaprylate, etc. The alkaline salts may be added separately from the corresponding acids or, if so desired, the alkaline salts may be formed in situ by adding an alkaline compound such as sodium hydroxide, potassium hydroxide, lithium hydroxide, calcium hydroxide, etc., to the reaction medium, thereby converting a portion of the acid which is present to the salt thereof.

In addition the presence of an acid of the type hereinbefore set forth and the corresponding alkali metal or alkaline earth metal salt thereof, the reaction is also effected in the presence of a phase transfer agent. In the preferred embodiment of the invention, these transfer agents will comprise symmetrical or asymmetrical tetraalkylnitrogen-based or phosphorus-based salts in which the alkyl radicals contain from 1 to about 20 carbon atoms in the chain. Some specific examples of these phase transfer agents will include tetramethylammonium hydroxide, tetraethylammonium hydroxide, tetrapropylammonium hydroxide, tetrabutylammonium hydroxide, tetrapentylammonium hydroxide, tetrahexylammonium hydroxide, tetranonylammonium hydroxide, tetradecylammonium hydroxide, tetradodecylammonium hydroxide, butyltrimethylammonium hydroxide, hexyltrimethylammonium hydroxide, heptyltrimethylammonium hydroxide, decyltrimethylammonium hydroxide, dodecyltrimethylammonium hydroxide, hexadecyltrimethylammonium hydroxide, eicosyltrimethylammonium hydroxide, diethyldimethylammonium hydroxide, dipropyldimethylammonium hydroxide, dibutyldimethylammonium hydroxide, dihexyldimethylammonium hydroxide, didecyldimethylammonium hydroxide, tributylammonium hydroxide, triheptylmethylammonium hydroxide, trinonylmethylammonium hydroxide, triundecylmethylammonium hydroxide, tripentadecylmethylammonium hydroxide, dibutyldiethylammonium hydroxide, dioctyldiethylammonium hydroxide, the corresponding sulfate, nitrate, chloride and bromide salts, etc.; tetramethylphosphonium hydroxide, tetrapropylphosphonium hydroxide, tetrapentylphosphonium hydroxide, tetranonylphosphonium hydroxide, tetradodecylphosphonium hydroxide, hexyltrimethylphosphonium hydroxide, decyltrimethylphosphonium hydroxide, hexadecyltrimethylphosphonium hydroxide, diethyldimethylphosphonium hydroxide, dibutyldimethylphosphonium hydroxide, didecyldimethylphosphonium hydroxide, triheptylmethylphosphonium hydroxide, triundecylmethylphosphonium hydroxide, dibutyldiethylphosphonium hydroxide, etc. the corresponding sulfate, nitrate, chloride and bromide salts, etc., It is to be understood that the aforementioned phase transfer agents are only representative of the types of agents which may be employed and that the present invention is not necessarily limited thereto.

As will hereinafter be shown in greater detail in the appended examples, we have now discovered that the ratio of ortho to para substituents which is obtained during the reaction is a function of the chain length of the quaternary alkyl nitrogen based or phosphorous based salt which is employed, the product isomer selectivity being influenced by the number of carbon atoms in the alkyl groups. For example, by utilizing short chain alkyl compounds such as tetraethylammonium hydroxide a 2.2:1 ratio of para to ortho isomers at a 20% conversion of anisole may be obtained. Conversely, when utilizing a relatively longer carbon chain such as tricaprylylmethylammonium hydroxide, the resulting isomer distribution will be at a 1.2:1 ratio of para to ortho isomers. Likewise, an intermediate length carbon chain such as tetrabutylammonium hydroxide will give a 1.7:1 ratio of para to ortho isomer at a 20% conversion. Therefore, it is readily apparent that the obtention of a desired position isomer may be effected by the selection of a phase transfer agent which possesses a particular number of carbon atoms in the alkyl chain.

The electrochemical cell in which the electrochemical oxidation of the alkoxy-subtituted aromatic compound is effected may be of any variety which is well known in the art. The electrodes which are employed may be formed of any conductive material, the preferred electrodes in the process of this invention comprising a platinum anode and a stainless steel cathode, although it is also contemplated that other conductive materials may also be employed. The electrochemical oxidation is effected utilizing an electrical energy which includes a voltage within the range of from about 2 to about 20 volts and a current density in the range of from about 20 to about 500 ma/cm$^2$. By utilizing a water emulsion which will include the aforementioned phase transfer agent, aliphatic acid, and alkaline salt thereof, as well as an organic solvent such as dichloromethane, diethyl ether, acetonitrile, etc., it will be possible to utilize a lower voltage and current density thereby reducing the power cost which will be required to effect the electrochemical oxidation.

The process of this invention may be effected in any suitable manner and may include both a batch type and continuous type operation. When a batch type operation is employed, an emulsion which will include the alkoxy-substituted aromatic compound such as anisole, the aliphatic acid which, due to the particular size and configuration thereof, will be of sufficient bulk to prevent the oxidation of the alkoxy-substituted aromatic compound in the ortho position, the alkali metal or alkaline earth metal salt thereof, water, the organic solvent and the phase transfer agent are charged to a flask which is provided with an overhead stirrer, reflux condenser and nitrogen purge tube. In addition, the flask is also provided with a bottom exit tube. The solution is then stirred and transferred from the flask to the electrochemical cell where the alkoxy-substituted aromatic compound is subjected to an electrochemical reaction for a predetermined period of time which may range from about 0.5 up to about 10 hours or more in duration, the electrical energy charged to the cell being within the range hereinbefore set forth. Upon completion of the desired residence time, the mixture is withdrawn from the cell and subjected to conventional means of separation which will include decantation, washing, drying, fractional distillation, etc., whereby the desired product is separated from unreacted starting materials, phase transfer agents, water, organic solvent, etc., and recovered.

It is also contemplated within the scope of this invention that the electrochemical oxidation of the alkoxy-substituted aromatic compound may also be effected in a continuous manner of operation. When such a type of operation is used, the aforementioned components of the reaction mixture, namely, the alkoxy-substituted aromatic compound, the fatty acid, its alkali metal or alkaline earth metal salt thereof, water, phase transfer agent and the organic solvent are all continuously charged to an electrochemical cell which is maintained at the proper operating conditions of temperature and pressure, said preferred conditions including ambient temperature and atmospheric pressure. After being subjected to an electrical charge for a predetermined period of time, the effluent is continuously withdrawn and subjected to conventional means of separation whereby the desired product is recovered.

The following examples are given to illustrate the process of this invention in which a preferred position isomer, namely, the para isomer, of an alkoxy-substituted aromatic compound which has been subjected to electrochemical oxidation is prepared and recovered. However, it is to be understood that these examples are given merely for purposes of illustration and that the present invention is not necessarily limited thereto.

EXAMPLE I

In this example an acetonitrile solvent system was used in the treatment of anisole with acetic acid. A mixture consisting of 9.6 grams (0.0978 mole) of potassium acetate, 52.5 grams of glacial acetic acid, 5.4 grams (0.0499 mole) of anisole and 52.5 grams of acetonitrile was admixed in a flask provided with an overhead stirrer, reflux condenser and nitrogen purge tube. In addition, the flask also contained a bottom exit tube and stop cock. The solution was stirred and transferred from the flask through a flow cell which had Teflon walls, a platinum anode and a stainless steel cathode. The electrical energy consisted of an E applied voltage of 8 volts, 1 ampere while maintaining the current density at a rate of about 50 ma/cm$^2$. The solution was passed through the cell and condenser and back to the cell by use of a pump. The reaction was effected for a period of about 3.5 hours, there being a 62.7% conversion with the ratio of ortho-acetoxyanisole to para-acetoxyanisole ranging from 54:45 at 10% conversion up to 72:27 at 62.7% conversion.

EXAMPLE II

In a manner similar to that set forth in Example I above, a mixture of 9.6 grams of potassium acetate, 5.4 grams of anisole, 52.2 grams of acetic acid and 52.4 grams of acetonitrile along with 1.0 grams of naphthalene was treated in a flow cell. The reaction was effected for a period of about 1.5 hours at ambient temperature and pressure using an E applied voltage of approximately 8 volts, 1 ampere and maintaining the current density at about 50 ma/cm$^2$. The ortho to para-acetoxyanisole ratio was 0.9:1.0 at conversions less than 10% and changing to a ratio of 1:1 at conversions of about 50%.

When the above experiment was repeated using an E applied voltage of about 7, the other conditions being similar, it was found that the ortho to para ratio of acetoxyanisole ranged from about 51:49 at conversions of less than 10% to 66:34 at reaction end.

EXAMPLE III

To illustrate the effect that bulky acids of the type hereinbefore set forth in greater detail as well as the use of phase transfer agents have on the ratio of isomers, a mixture consisting of 31.2 grams (37.3% solution in $H_20$) of tetrabutylammonium sulfate, 80.5 grams of water, 75.4 grams of dichloromethane, 8.2 grams of anisole and 14.1 grams of potassium pivalate was mixed and passed through a flow cell which possessed Teflon walls, a platinum anode and a stainless steel cathode. The reaction was effected at ambient temperature and pressure for a period of 4.5 hours using an E applied voltage ranging from about 4.6 to 4.9 volts along with 1 ampere and a current density in the range of about 50 ma/cm$^2$. Analysis of the product which resulted from this showed that the ratio of ortho to para isomer was about 44:56. Therefore, it was determined that by utilizing an emulsion type technique it was possible to obtain a greater amount of the para isomer than the ortho isomer.

EXAMPLE IV

In this example a mixture of 5.6 grams of anisole, 21.2 grams of sodium pivalate, 10.2 grams of pivalic acid, 133.5 grams of dichloromethane, 80.5 grams of water and 15.6 grams of a 37.3% solution of tetrabutylammonium sulfate in $H_20$ was mixed together, added to a flask of the type hereinbefore described, stirred and transferred from the flask through a flow cell which was similar in nature to that hereinbefore described. The electrochemical oxidation of the anisole was effected using an E applied voltage of 8.0 volts along with about 1-2 amperes and a current density of about 50 ma/cm$^2$. The reaction was effected for a period of 6.75 hours. The product which was obtained was analyzed by means of gas-liquid chromatography. The ratio of ortho to para isomer of the product ranged from 37:63 to 44:56. Therefore, it can be seen that by utilizing both a bulky acid such as pivalic acid and the sodium salt thereof it is possible to obtain a greater amount of the desired para isomer.

A repeat of the above experiment utilizing 5.6 grams of anisole, 21.2 grams of sodium pivalate, 10.2 grams of pivalic acid, 133.5 grams of dichloromethane, 80.5 grams of water and 15.6 grams of a 37.3% solution of tetrabutylammonium sulfate for a period of 5 hours at ambient temperature and atmospheric pressure resulted in the obtention of a product which, by gas chromatographic analysis, showed an ortho to para ratio of 37:63 of the product.

EXAMPLE V

In this example a mixture similar to that set forth in Example IV above was used with the addition of 2.2 grams of naphthalene, a strong $\pi$-donating compound. The addition of the naphthalene was made to determine whether or not, under emulsion conditions, the naphthalene would effect the ortho to para ratio of product. The mixture was passed through a flow cell which possessed a platinum anode and stainless steel cathode for a period of 5.5 hours, under an E applied voltage of 7 volts along with 1 ampere and a current density of about 50 ma/cm$^2$. Samples which were taken at various times during the reaction and analyzed by gas chromatography showed that at a 10% conversion, there was a 37:63 ortho to para ratio. This ratio remained up to 50% conversion.

EXAMPLE VI

This experiment was performed using anisole as both a solvent and a substrate. A mixture consisting of 21.2 grams of sodium pivalate, 10.2 grams of pivalic acid, 90 grams of water, 101 grams of anisole and 15.6 grams of a 37.3% solution of tetrabutylammonium sulfate was treated in a manner similar to that hereinbefore set forth. The electrochemical oxidation was effected using an E applied voltage ranging from 15.7 to 19.3 volts, about 1 ampere and a current density of about 50 ma/cm$^2$. The reaction was effected for a period of about 4 hours, the ortho to para ratio of product being 40:60.

When the above experiment was repeated using 71.5 grams of diethyl ether as the solvent in place of the greater amount of anisole, the ortho to para ratio was approximately the same, that is, 40:60.

When the electrochemical oxidation of anisole was repeated using like amounts of reactants, transfer agents and chloroform in place of diethyl ether, the ortho to para ratio ranged from 36:64 to 39:61. Therefore it is readily apparent from a comparison of Examples I and II with Examples IV, V and VI that by utilizing a bulky acid and an alkaline salt thereof as well as a phase transfer agent in an emulsion technique, it is possible to obtain a greater amount of the para isomer than could be obtained when not utilizing this type of reaction.

EXAMPLE VII

To illustrate the effect the length of the alkyl chains in the phase transfer agent has upon the ratio of the ortho:para isomer, a series of experiments was performed in which various tetraalkylammonium hydroxides were utilized. In the first experiment, a mixture of 5.7 grams (0.053 mole) of anisole 8.0 grams (0.20 mole) of sodium hydroxide, 32.2 grams (0.32 mole) of pivalic acid, 90 grams of water, 136.4 grams of methylene dichloride and 11.0 grams of tetraethylammonium hydroxide were treated in a manner similar to that set forth above, that is, by admixing the reactants, adding the mixture to a flask, stirring and transferring the mixture to a flow cell. The electrochemical oxidation of the anisole was effected using an E applied voltage of from 19 to 20 volts along with an average of 0.5 amperes and a current density of about 50 ma/cm$^2$. The reaction was effected for a period of about 7 hours. The product which was obtained was analyzed by means of gas-liquid chromatography which determined that at 16.8% conversion of anisole, the ortho:para isomer ratio was 31:69. This conversion was accomplished at a current efficiency of 30.4. Further sampling and analysis disclosed that at a 22.5% conversion, the ortho:para isomer ratio was 32:68 and at 28.3% conversion the ortho:para ratio was 33:67.

When the above experiment was repeated utilizing 30.5 grams of a 10% tetrapropylammonium hydroxide solution in water at an E applied voltage of about 7 volts, an average of about 0.93 amperes and a current density of about 50 ma/cm$^2$, the ortho:para isomer ratio at 8% conversion was 33:67; at 18.1% conversion, the ratio was 35:65, and at 52.4% conversion, the ratio was 38:62. The current efficiency of the reaction was 22.7; 24.7 and 29.6 respectively.

A third experiment to illustrate the variance in ortho:para isomer ratio which can be obtained by varying the chain length of the phase transfer agent was performed in which anisole, pivalic acid, methylene dichloride, water and sodium hydroxide were admixed with 14.6 grams of a 27.2% solution of tricaprylylmethylammonium hydroxide in water. As in the preceding experiments, the reaction was run at an E applied voltage of 7.4 volts, an average 1.1 ampere and a current density of about 50 ma/cm$^2$. The reaction was effected for a period of about 7.5 hours. Analysis of the product by means of gas-liquid chromatography determined that at a 15.4% conversion of the anisole the ortho:para ratio was 46:54 at a current efficiency of 19.1% while at a 30.3% conversion of anisole, the ortho:para ratio was 45:55 while the current efficiency dropped to 17.8%.

It is therefore readily apparent that by utilizing a phase transfer agent in which the alkyl chain length is relatively short, it is possible to obtain a much greater ratio of para isomer to ortho isomer than can be obtained when using a phase transfer agent in which the chain length of the alkyl radicals is relatively long in nature as exemplified by the tricaprylylmethylammonium hydroxide.

EXAMPLE VIII

As a further illustration of the effect that specific acids have on the formation of ortho or para isomers and the ratio of one to another, a series of experiments was run utilizing carboxylic acids containing various numbers of carbon atoms in the chain. In each instance the reactants comprised 0.5 mole of anisole, 0.1 mole of the acid, 0.17 mole of sodium salt, 101 grams of water, 135 grams of methylene dichloride and 10 millimoles of tributylammonium sulfate. The electrochemical oxidation of the anisole was effected using an E applied voltage of from 6 to 7 volts along with approximately 1 ampere and a current density of about 50 ma/cm$^2$. The results of these tests are set forth in Table I below:

TABLE I

| Acid | Ortho:Para Ratio At 20% Conversion Of Anisole | Current Efficiency % |
|---|---|---|
| Acetic | 50:50 | 33.7 |
| Propionic | 47:53 | 48.9 |
| n-Butyric | 43:57 | 40.0 |
| n-Valeric | 42:58 | 34.3 |
| Isovaleric | 41:59 | 36.2 |
| Pivalic | 37:63 | 21.7 |

It is apparent from the above table that by utilizing acids which may be considered bulky due to the number of carbon atoms present in the chain, it is possible to obtain greater amounts of the para position isomer. This occurs when there is an increase in both the carbon number of the branched character of the acid chain as evidenced by the wide variance in the amount of para isomer produced when using acetic acid as compared to the use of pivalic acid. While the increased production of the para isomer is achieved at the expense in the decrease in the current efficiency, the latter results from the decrease in oxidation potential which is exhibited by the higher carbon number acids. However, this decrease in efficiency is more than overcome by the increased amount of the desired para isomer which is produced by carboxylic acids which contain a greater number of carbon atoms.

EXAMPLE IX

In this example a mixture comprising 5.7 grams of anisole, 8.0 grams of sodium hydroxide, 32.2 grams of pivalic acid, 90 grams of water, 136 grams of methylene dichloride , and 12.0 grams of dodecyltrimethylammonium chloride may be treated in a manner similar to that set forth in the above examples, that is, by admixing the reactants, adding the mixture to a flask, stirring and thereafter transferring said mixture to a flow cell. The electrochemical oxidation of the anisole may be effected using an E applied voltage of from 19 to 20 volts along with an average of 0.5 amperes and a current density of about 50 ma/cm$^2$ for a period of about 7 hours. The resulting product should show a greater percentage of para-acetoxyanisole to the ortho isomer.

Similar reactions using diethyldi-t-butylphosphonium bromide and hexyltrimethylphosphonium hydroxide as phase transfer agents may give similar results.

We claim as our invention:

1. A process for the electrochemical oxidation of an alkoxy-substituted aromatic compound which comprises treating said compound a temperature in the range of from about 0° to about 100° C. and a pressure in the range of from about atmospheric to about 100 atmospheres with an acid having the formula:

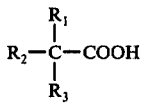

in which at least 2 R's are alkyl groups containing from 1 to about 10 carbon atoms and the remaining R is hydrogen or an alkyl group containing from 1 to about 10 carbon atoms and an alkali or alkaline earth metal salt of such an acid and a phase transfer agent comprising a symmetrical or asymmetrical tetraalkylnitrogen or phosphorus-based salt containing from 1 to about 20 carbon atoms in the alkyl chain, in an electrochemical cell maintained at a voltage in the range of from about 2 to about 20 volts and a current density in the range of from about 20 to about 200 milliamperes/cm$^2$, and recovering the resultant acetoxylated alkoxy-substituted aromatic compound.

2. The process as set forth in claim 1 in which said phase transfer agent is dodecyltrimethylammonium chloride.

3. The process as set forth in claim 1 in which said phase transfer agent is tetrapropylammonium sulfate.

4. The process as set forth in claim 1 in which said phase transfer agent is tetra-t-butylammonium sulfate.

5. The process as set forth in claim 1 in which said phase transfer agent is tetraethylphosphonium chloride.

6. The process as set forth in claim 1 in which said phase transfer agent is diethyldi-t-butylphosphonium bromide.

7. The process as set forth in claim 1 in which said salt of said acid is formed in situ by the addition of an alkaline compound to the reaction mixture.

8. The process as set forth in claim 1 in which said acid is pivalic acid and said alkali metal salt of such an acid is sodium pivalate.

9. The process as set forth in claim 1 in which said acid is isovaleric acid and said alkali metal salt of such an acid is potassium isovalerate.

10. The process as set forth in claim 1 in which said acid is isobutyric acid and said alkali metal salt of such an acid is sodium isobutyrate.

* * * * *